US008050596B2

(12) United States Patent
Jun

(10) Patent No.: US 8,050,596 B2
(45) Date of Patent: Nov. 1, 2011

(54) DEVELOPER CARTRIDGE WITH DEFORMABLE MEMBER, AND IMAGE FORMING APPARATUS HAVING THE SAME

(75) Inventor: Jong-pil Jun, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/013,712

(22) Filed: Jan. 14, 2008

(65) Prior Publication Data

US 2009/0028599 A1 Jan. 29, 2009

(30) Foreign Application Priority Data

Jul. 25, 2007 (KR) ..... 10-2007-0074361

(51) Int. Cl.
*G03G 15/08* (2006.01)

(52) U.S. Cl. ..... 399/260

(58) Field of Classification Search ..... 399/103, 399/119, 258, 262, 260, 256
See application file for complete search history.

(56) References Cited

U.S. PATENT DOCUMENTS

| | | | | |
|---|---|---|---|---|
| 5,629,758 | A | 5/1997 | Kageyama | |
| 7,962,071 | B2 * | 6/2011 | Tsuda et al. | 399/260 |
| 2008/0181670 | A1 * | 7/2008 | Tsuda et al. | 399/234 |
| 2011/0091228 | A1 * | 4/2011 | Ikeda | 399/53 |

FOREIGN PATENT DOCUMENTS

| | | | | |
|---|---|---|---|---|
| EP | 1950627 | A1 | | 7/2008 |
| JP | 61196273 | A | * | 8/1986 |
| JP | 01302282 | A | * | 12/1989 |
| JP | 07199657 | A | * | 8/1995 |
| JP | 10048948 | A | * | 2/1998 |
| JP | 2003337466 | A | * | 11/2003 |
| JP | 2004029596 | A | * | 1/2004 |
| JP | 2008111998 | A | * | 5/2008 |

OTHER PUBLICATIONS

Computer Translation of JP07-199657A.*
European Search Report Issued Nov. 19, 2008 in Europe Application No. 08153590.8.

* cited by examiner

*Primary Examiner* — Quana M Grainger
(74) *Attorney, Agent, or Firm* — Stanzione & Kim, LLP

(57) ABSTRACT

A developer cartridge of an image forming apparatus includes a cartridge frame having a developer chamber holding a developer therein, and a developer discharging port, a developer conveying unit rotatably installed on the cartridge frame to agitate and move the developer towards the developer discharging port, and an elastic damper to change the size of a developer discharge space defined by the vicinity to the developer discharging port according to a developer delivery pressure of the developer conveying unit. The damper contracts to increase a size of the developer discharge space and reduce the developer delivery pressure, when the developer delivery pressure increases above a normal pressure in the developer chamber.

43 Claims, 7 Drawing Sheets

DEVELOPER CARTRIDGE WITH DEFORMABLE MEMBER, AND IMAGE FORMING APPARATUS HAVING THE SAME

CROSS-REFERENCE TO RELATED APPLICATIONS

This application claims priority under 35 U.S.C. §119 (a) from Korean Patent Application No. 10-2007-0074361, filed on Jul. 25, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus having a removable developer cartridge, and more particularly, to a developer cartridge to supply a developer, and an image forming apparatus having the same.

2. Description of the Related Art

Generally, an electrophotographic image forming apparatuses, such as copier, printer, multi-function unit, or facsimile, includes a photosensitive medium on which an electrostatic latent image is formed, a developing device to developing an electrostatic latent image on the photosensitive medium with a developer, a transfer device to transfer the developed image onto a printing medium, and a fusing device to fix the transferred image into the printing medium.

A color image forming apparatus having a removable developer cartridge generally includes a plurality of color developer cartridges removably mounted on a main body to supply developers of different colors. Accordingly, an expired developer cartridge can be replaced with a new one.

A removable developer cartridge for use in an image forming apparatus generally includes a cartridge frame that includes a developer chamber and a developer discharging port, a developer conveying unit such as an auger which is rotatably mounted on the cartridge frame to agitate developer within the developer chamber and convey the developer towards the developer discharging port.

The image forming apparatus also includes a main body having a driving unit to rotate the auger of the developer cartridge, and a developer conveying duct to connect the developer discharging port of the developer cartridge with the developing cartridge.

As the developer cartridge is mounted on the main body of the image forming apparatus, the auger and the driving unit are connected with each other by a coupling, and as a result, the auger rotates as the image forming apparatus starts an operation. The rotation of the auger agitates the developer within the developer chamber of the developer cartridge, causing the developer to be conveyed towards the developer discharging port. Accordingly, the developer is discharged through the developer discharging port and supplied to the developing cartridge to be used in a developing process.

Because the amount of developer to discharge through the developer discharging port during the auger's conveying of developer is limited, toner sometimes accumulates and hardens particularly in a developer discharging space that can be defined as the vicinity to the developer discharging port, causing the auger to be locked and subsequently interrupting supply of the developer.

Particularly when the developer distribution within the developer cartridge is unbalanced due to an impact exerted during shipping, or when a developer cartridge is exchanged, the delivery pressure reaches a maximum value. Because of the limited absolute quantity of developer to discharge through the developer discharging port, auger is highly likely to be locked, causing interruption of developer supply.

The above problems may be lessened by decreasing the amount of developer being conveyed. However, this would be disadvantageous especially when an image consumes a relatively large amount of a developer, because a system would not be directly printing but wait until the developer is sufficiently supplemented. As a result, the images requiring a large amount of a developer are frequently printed with interruptions.

It has been suggested that an oppositely-spiraling wing be added to an end of the auger to reduce a developer delivery pressure. Although this may be effective in temporarily increasing the developer delivery pressure, the auger can be locked by the hardened developer formed inside a developer cartridge, and ability to supply the developer is also deteriorated than a conventional cartridge.

SUMMARY OF THE INVENTION

The present general inventive concept provides a developer cartridge to prevent auger locking due to rising a developer delivery pressure, and to prevent the rising developer delivery pressure in a developer discharge space, and an image forming apparatus having the same.

The present general inventive concept also provides a developer conveying unit having a damper to release an excessive developer delivery pressure, by varying a size of a developer discharge space according to the developer delivery pressure in a developer chamber.

Additional aspects and utilities of the present general inventive concept will be set forth in part in the description which follows and, in part, will be obvious from the description, or may be learned by practice of the general inventive concept.

The foregoing and other aspects and utilities of the present general inventive concept may be achieved by providing a developer cartridge, including a cartridge frame having a developer chamber to contain a developer therein, and a developer discharging port, a developer conveying unit to convey the developer towards the developer discharging port, and a deformable unit to change a size of a developer discharge space defined by the vicinity to the developer discharging port according to the developer delivery pressure of the developer conveying unit.

The deformable unit may include a deformable damper installed on the developer conveying unit. The damper may be capable of contracting and expanding along the axis of the developer conveying unit. The damper contracts in the axis direction and thus diminishes in thickness when the developer delivery pressure excessively applies in the developer chamber, to expand the size of the developer discharge space and release the excessive developer delivery pressure. Accordingly, auger locking due to hardy toner is prevented, because toner does not mounts and harden at the developer discharge space.

The developer conveying unit may include a sealing member to prevent ingress of the developer through a shaft hole of the cartridge frame on which the developer conveying unit is installed. The damper may be installed on the sealing member.

The damper may include an elastic member, and may further include a film member attached to the surface of the elastic member. The elastic member may be made out of sponge or rubber material including silicone, urethane, EPDM, NBR, NR, and poron. The film member may be made out of a material such as PET, PP, urethane, and silicone, to prevent rise of the damper's surface resistivity due to friction with the developer.

The developer conveying unit may be rotatably installed on the cartridge frame to agitate the developer within a developer chamber.

The developer conveying unit may include an auger having a shaft, and a spiral wing disposed along the outer circumference of the shaft. The auger may further include a sealing member to prevent ingress of the developer through a shaft hole of the cartridge frame on which the auger is installed. The damper may be installed on the sealing member.

The damper may include an elastic member attached to the sealing member, and a film member attached to the elastic member.

The foregoing and other aspects and utilities of the present general inventive concept may also be achieved by providing an image forming apparatus including a developing cartridge installed in a main body of the image forming apparatus, to develop an electrostatic latent image on a photosensitive medium with a developer, a developer cartridge removably mounted to the main body of the image forming apparatus, and a developer conveying duct to connect a developer discharging port of the developer cartridge with the developing cartridge approximately vertically.

The developing cartridge and the developer cartridge may each include a plurality of cartridges to represent a plurality of colors respectively.

The foregoing and other aspects and utilities of the present general inventive concept may also be achieved by providing a developer conveying unit rotatably installed on a developer cartridge having a developer chamber and a developer discharging port, to agitate the developer inside the developer chamber and move the developer towards the developer discharging port, which includes a shaft, a spiral wind disposed along the outer circumference of the shaft, a sealing member to prevent ingress of the developer through a shaft hole of the developer cartridge, and a damper installed on the sealing member to vary the size of a developer discharge space defined by the vicinity to the developer discharging port according to developer delivery pressure.

The damper contracts in the axis direction when the developer delivery pressure excessively applies in the developer chamber, to expand the size of the developer discharge space and release the excessive developer delivery pressure.

The damper may be made out of an elastic member, or may further include a film member attached to the surface of the elastic member. The elastic member may be made out of sponge or rubber material such as silicone, urethane, EPDM, NBR, NR, and poron. The film member may be made out of a material such as PET, PP, urethane, and silicone, to prevent rise of the damper's surface resistivity due to friction with the developer.

The foregoing and other aspects and utilities of the present general inventive concept may also be achieved by providing a developer conveying device useable with a developer cartridge, including a developer conveying unit to convey a developer to a developer discharge space, and a deformable unit to change the developer discharge space according to a pressure of the developer discharge space.

The developer conveying unit may include a shaft and a plate formed on the shaft to convey the developer toward the developer discharge space, and the deformable unit may be include a damper.

The foregoing and other aspects and utilities of the present general inventive concept may also be achieved by providing a developer cartridge usable with an image forming apparatus, including a cartridge frame having a developer chamber to contain a developer and a developer discharge space, a developer conveying unit to convey the developer to the developer discharge space, and a deformable unit to change the developer discharge space.

The cartridge frame may include a developer discharge port disposed to communicate with the developer discharge space such that the developer is conveyed toward the developer discharge space and discharged through the developer discharge port, and the deformable unit may be deformed to change a pressure of the developer discharge space to avoid a malfunction of the developer conveying unit.

The deformable unit may reduce one of a pressure and density of the developer discharge space by changing a size of the developer discharge space.

The deformable unit may have a first surface to be stationary and a second surface to be movable with respect to the first surface according to the pressure of the developer space.

The second surface may form a portion of the developer discharge space, and the second surface may move to increase the developer discharge space to decrease a pressure of the developer discharge space.

The deformable unit may have a first surface and a second surface to move between a first position and a second position with respect to the first surface to change a size of the developer discharge space.

The deformable unit may be changed between a first shape and a second shape to change a pressure of the developer discharge space.

The deformable unit may be a damper formed with the developer conveying unit in a single body to repeatedly move between a first position and a second position according to a pressure of the developer discharge space to adjust the pressure of the developer discharge space.

The foregoing and other aspects and utilities of the present general inventive concept may also be achieved by providing an image forming apparatus, including a developer cartridge unit having a cartridge frame having a developer chamber to contain a developer and a developer discharge space, a developer conveying unit to convey the developer to the developer discharge space, and a deformable unit to change the developer discharge space, and an image forming device to form an image on a printing medium using the developer.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
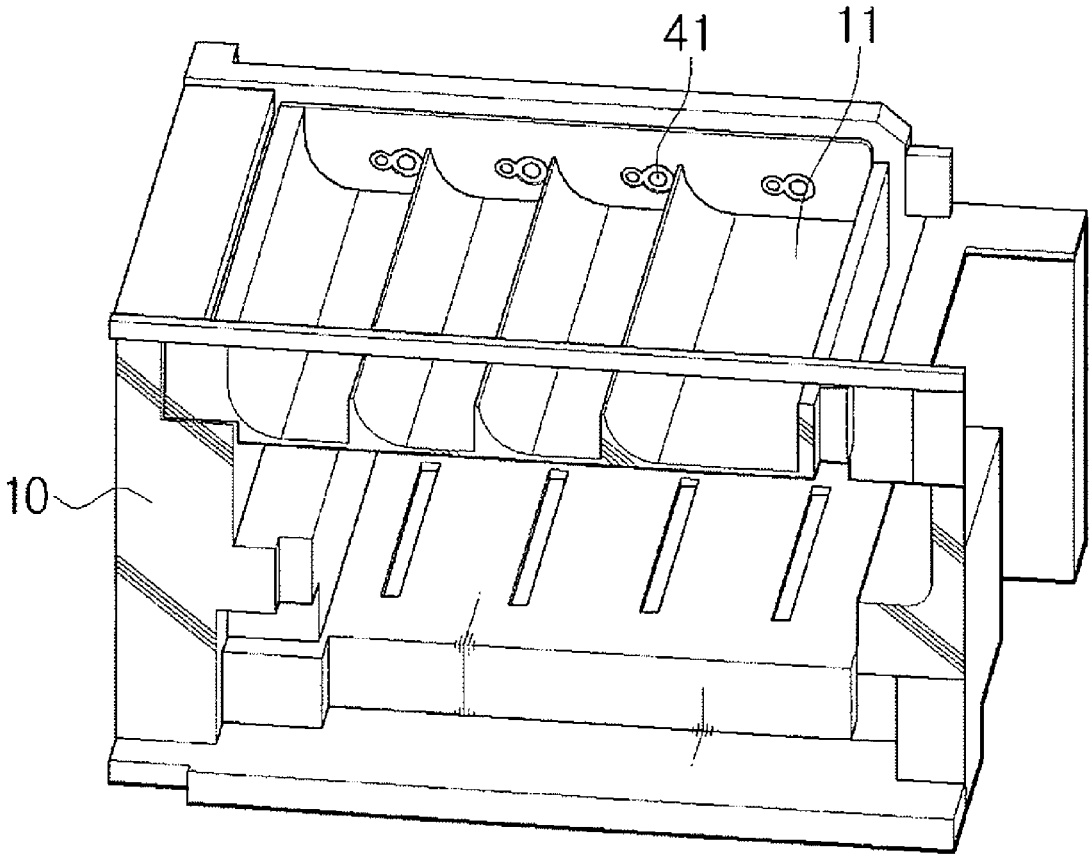
FIGS. 1A and 1B are perspective view illustrating an image forming apparatus according to an example embodiment of the present general inventive concept.
Figure 1B:
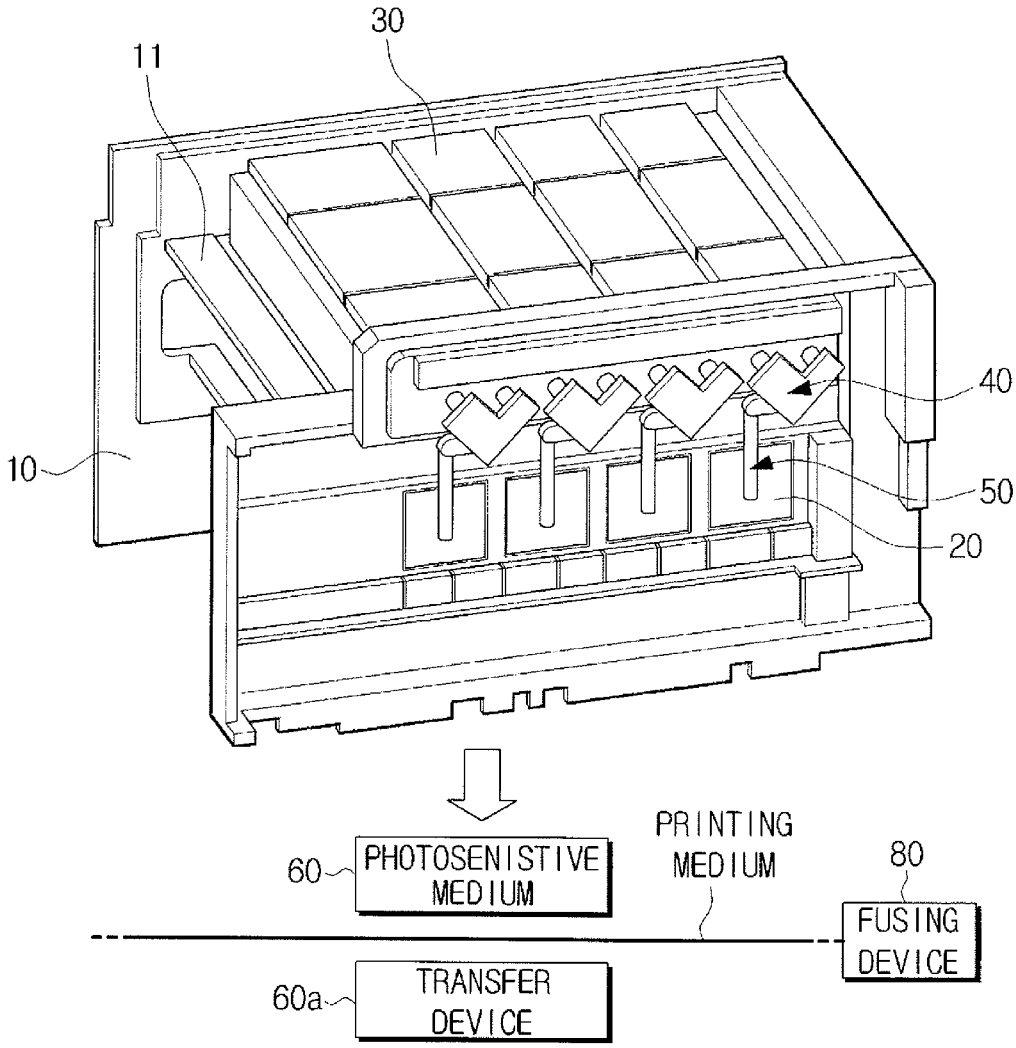

Reference will now be made in detail to the embodiments of the present general inventive concept, examples of which are illustrated in the accompanying drawings, wherein like reference numerals refer to the like elements throughout. The embodiments are described b Referring to FIGS. 1A and 1B, an image forming apparatus according to an example embodiment of the present general inventive concept includes a main body 10 to house a plurality of developing cartridge mounts (not illustrated) and a plurality of developer cartridge mounts 11, a first plurality of developing cartridges 20 mounted to the plurality of developing cartridge mounts (not illustrated), and a second plurality of developer cartridges 30 mounted to the plurality of developer cartridge mounts 11 to supply a developer to a corresponding one of the developing cartridge. For example, a first set of four developing cartridges 20 and a second set of four developer cartridges 30 may be provided to correspond to colors of yellow, magenta, cyan and black.

The image forming apparatus additionally includes a plurality of driving units 40 to drive the developer cartridges 30, and a plurality of developer conveying ducts 50 to connect the developer cartridges 30 with the developing cartridges 20 so that the developer discharged from the developer cartridges 30 is supplied to the corresponding developing cartridges 20.

The image forming apparatus according to an example embodiment of the present general inventive concept also includes a photosensitive medium 60 on which an electrostatic latent image is formed, a developing device to develop the electrostatic latent image of the photosensitive medium with a developer, a transfer device 60*a* to transfer the developed image onto a printing medium, and a fusing device 80 to fix the transferred image into the printing medium. The developing device may include the developer cartridge 30. The image forming apparatus may further include a feeding unit to feed the printing medium and a discharge unit to discharge the printing medium. Here, the above-described elements, for example, the photosensitive medium 60, the developing device, the transfer device 60*a*, the fusing device 80, may be referred to as an image forming device to form an image on the printing medium.

Figure 2:
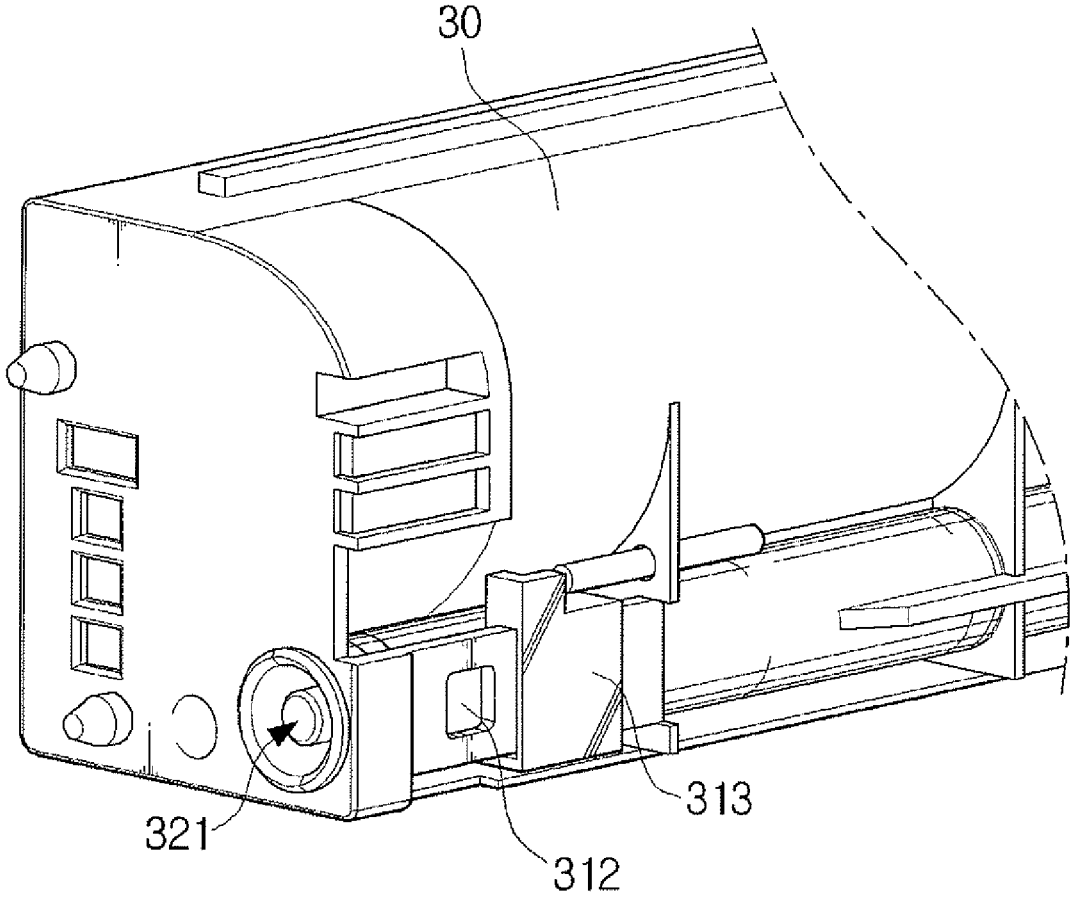
FIG. 2 is a partial perspective view illustrating a developer cartridge according to an example embodiment of the present general inventive concept.
Figure 3:
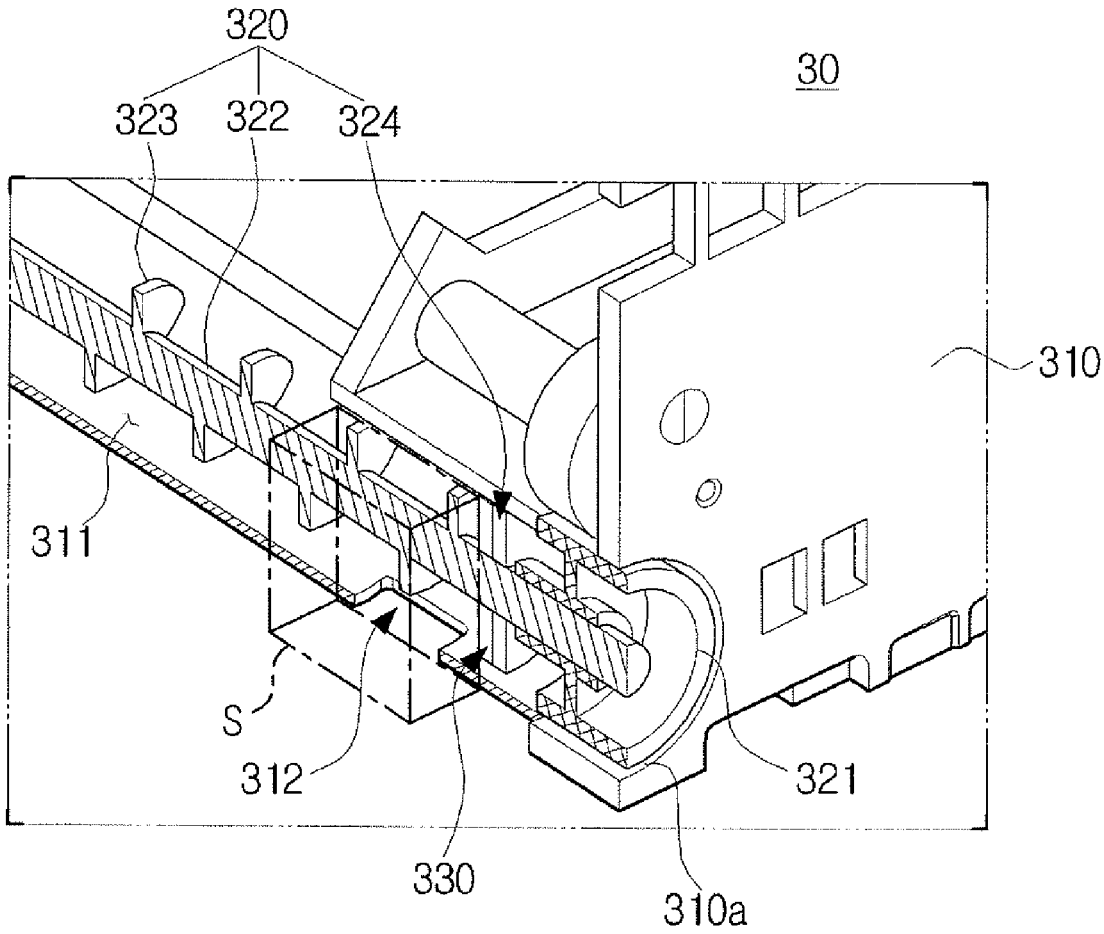
FIG. 3 is a partially cut, perspective view illustrating a developer cartridge according to an example embodiment of the present general inventive concept.
Figure 4:
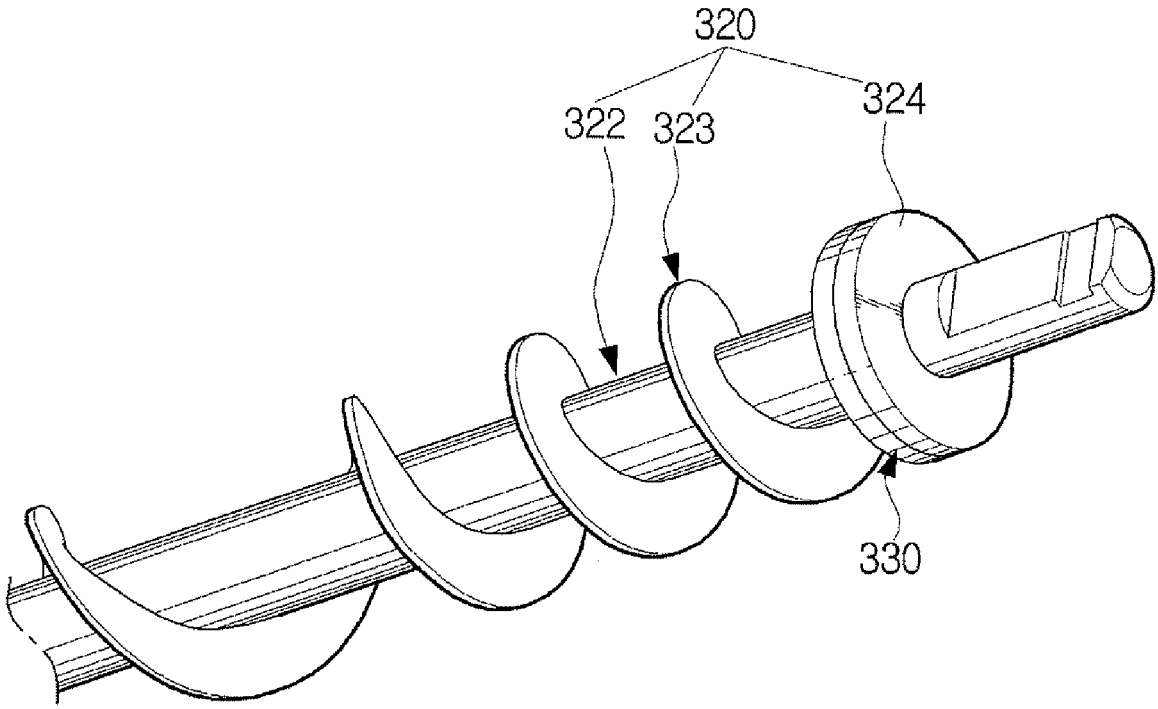
FIG. 4 is a perspective view illustrating a developer conveying unit that includes a damper according to an example embodiment of the present general inventive concept.

Referring to FIGS. 2 to 4, the developer cartridges 30 each includes a cartridge frame 310 having a developer chamber 311 to hold the developer, and a developer discharging port 312, a developer conveying unit 320 rotatably disposed in the developer chamber 311, and a damper 330 provided in the developer conveying unit 320.

The cartridge frame 310 includes a slidable shutter 313 which is elastically biased towards a direction to close the developer discharging port 312. The shutter 313 slides towards a direction to open the developer discharging port 312, when the developer cartridge 30 is mounted to the developer cartridge mount 11 of the main body 10.

The developer conveying unit 320 is disposed in the developer chamber 311 along a lengthwise direction, and includes both ends disposed in shaft holes 310*a* formed at and/or defined by both sidewalls of the cartridge frame 310 to be rotatably supported by the sidewalls of the cartridge frame 310. A coupler 321 is provided at one end of the developer conveying unit 320. As the developer cartridge 30 is mounted to the developer cartridge mount 11 of the main body 10, the coupler 321 is coupled with a coupler 41 of the driving unit 40 positioned at the developer cartridge mount 11, causing the developer conveying unit 320 to rotate.

The developer conveying unit 320 includes a shaft 322, and a plate, such as a spiral wing 323, formed along an outer circumference of the shaft 322. As the developer conveying unit 320 rotates, the plate can agitate the developer contained in the developer chamber 311, and/or can convey the developer toward the developer discharging port 312. The developer conveying unit 320 also includes a sealing member, such as a circular sealing member 324, to prevent ingress of developer through a shaft hole 310*a* of the cartridge frame 310 while being agitated and/or conveyed. The developer conveying unit 320 may be implemented as an auger. Accordingly, the developer conveying unit 320 ensures that the developer of the developer chamber 311 is supplied to the developing cartridge 20 efficiently through the developer discharging port 312 and the developer conveying duct 50.

The damper 330 may be made of an elastic material so that the damper 330 contracts during the developer conveyance by the developer conveying unit 320, when excessive pressure applies to a developer discharging space (S) defined as the vicinity of the developer discharging port 312, thereby expanding a characteristic, for example, such as a size or a volume. of the developer discharging space (S) and subsequently releasing the excessive pressure.

When the developer is conveyed toward the developer discharge space S, a density difference between the developer discharge space S and other spaces in the developer chamber 311 generates the pressure exerted to the developer discharge space S and then to the damper 330. It is possible that the developer discharge space S has a higher density than other area of the developer chamber 311 when the developer is conveyed toward the developer discharge space S, causing the accumulated developer in the developer discharge space S to push the damper 311. Here, the characteristic of the developer discharge space S can be referred to as pressure and/or density of the developer.

Figure 5:
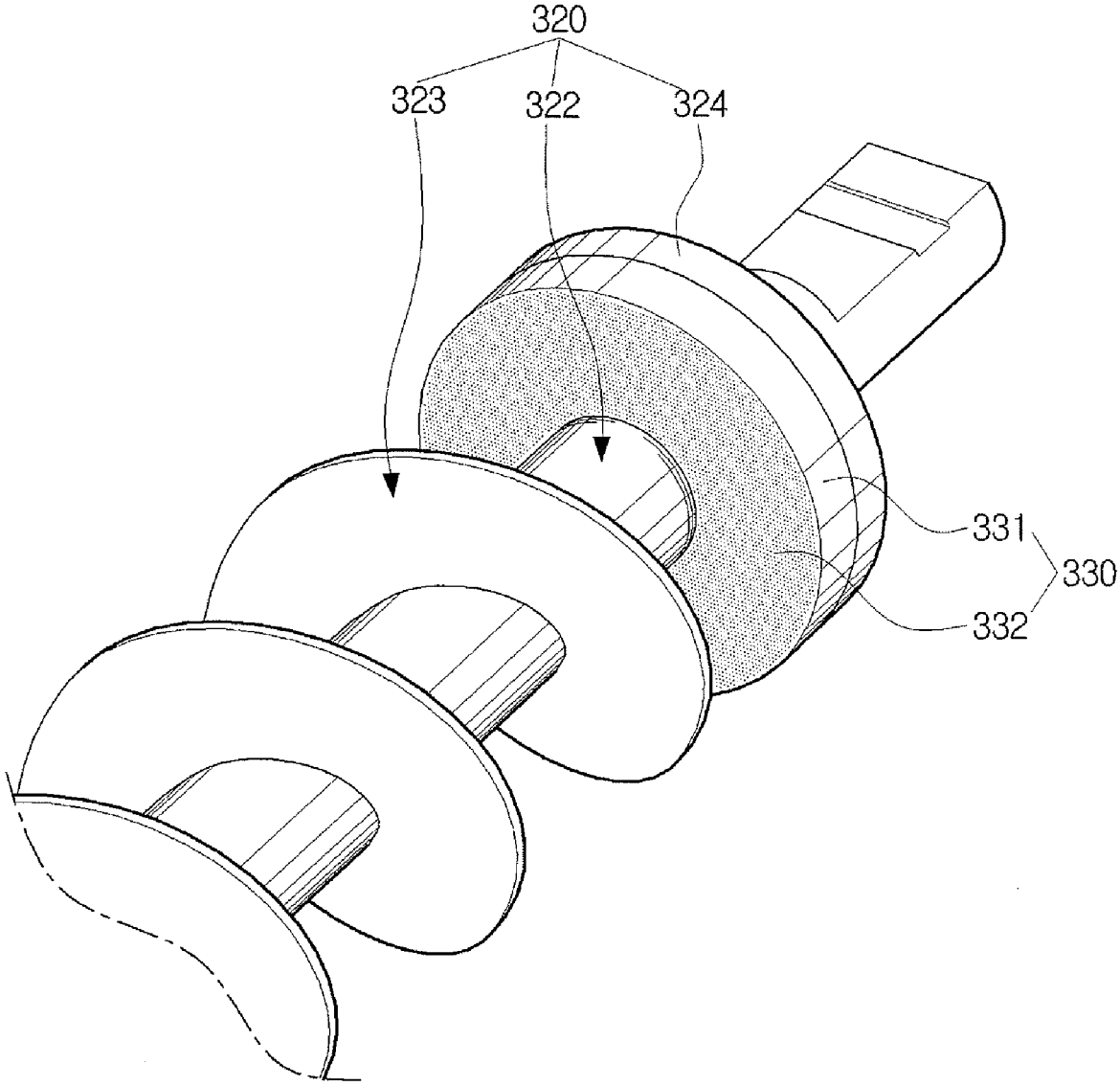
FIG. 5 is a view illustrating a portion of the developer conveying unit of FIG. 4.

However, the damper 330 is one example of a deformable unit to contract and expand to vary the size of the developer discharging space (S) appropriately according to a delivery pressure applied as the developer conveying unit 320 operates. As illustrated in FIG. 5, the damper 330 may include an elastic member 331 attached to the sealing member 324 of the developer conveying unit 320, and a film member 332 attached to the surface of the elastic member 331.

The elastic member 331 may be made of sponge or rubber material including silicone, urethane, EPDM, NBR, NR, or poron, but should not be understood as limiting. Therefore, any elastic material that can deform under pressure and recover upon release of the pressure, may be employed as the elastic member 331. The film member 332 is attached to the elastic member 331 to prevent the rise of surface resistivity due to friction between the elastic member 331 and the developer. The film member 332 may be made out of materials that include PET, PP, urethane, or silicone.

While the damper 330 is described and depicted as being attached to the sealing member 324 of the developer conveying unit 320 in the example embodiment explained above, one will understand that other alternatives are possible. For example, the damper 330 may be disposed on the shaft 322 of the developer conveying unit 320 to act as a sealing element and also to vary the size of the developer discharging space (S) according to the developer delivery pressure.

The deformable unit, for example, the damper 330, may be disposed to absorb the excessive pressure applied to the developer discharge space S and/or the developer discharging port 312. The deformable unit may have an original shape and another shape deformed from the original shape according to the pressure of the developer discharge space S and/or the developer discharging port 312 to change or lower the pressure of the developer in the developer discharge space S and/or the developer discharging port 312. It is possible that the deformable unit includes a first surface and a second surface to move with respect to the first surface according to a pressure of the developer discharge space S.

A method of supplying a developer from a developer cartridges usable with an image forming apparatus according to the example embodiment of the present general inventive concept will be explained in greater detail below with reference to FIGS. 1A, 1B, 2, 6A and 6B.

As the developer cartridge 30 is mounted to the developer cartridge mount 11 of the main body 10, the coupler 321 is coupled with the coupler 41 of the driving unit 40 positioned at the developer cartridge mount 11, causing the developer conveying unit 320 to rotate. As the developer conveying unit 320 rotates, the developer contained in the developer chamber 311 is agitated and/or conveyed toward the developer discharging port 312 through the developer discharging port 312. The developer of the developer chamber 311 is supplied to the developing cartridge 20 placed therebelow through the developer discharging port 312 and the developer conveying duct 50.

While the amount of a developer discharged through the developer discharging port 312 is kept relatively steady, constant rotation of the developer conveying unit 320 can increase a developer delivery pressure at a developer conveying and/or delivering path, particularly at the developer discharging space (S) defined as the vicinity to the developer discharging port 312. This phenomenon is especially severe when the developer cartridge 30 has an unbalanced distribution of developer due to impact exerted during shipping, or immediately after the replacement of developer cartridge 30.

If the developer delivery pressure exceeds a normal value (or pressure) at the developer discharging space (S), the developer mounts and hardens at this area, causing the developer conveying unit 320 to instantly stop rotating, that is, to lock (stall), and to subsequently interrupt the developer supply. This undesirable phenomenon has to be avoided.

The damper 330 according to the example embodiment of the present general inventive concept solves the above problem, by contracting if the more than required developer delivery pressure is exerted in the developer discharging space (S) to thus expand the size of the developer discharging space (S) and reduce the excessive pressure. This will be explained in detail below with reference to FIGS. 6A and 6B.

Figure 6A:
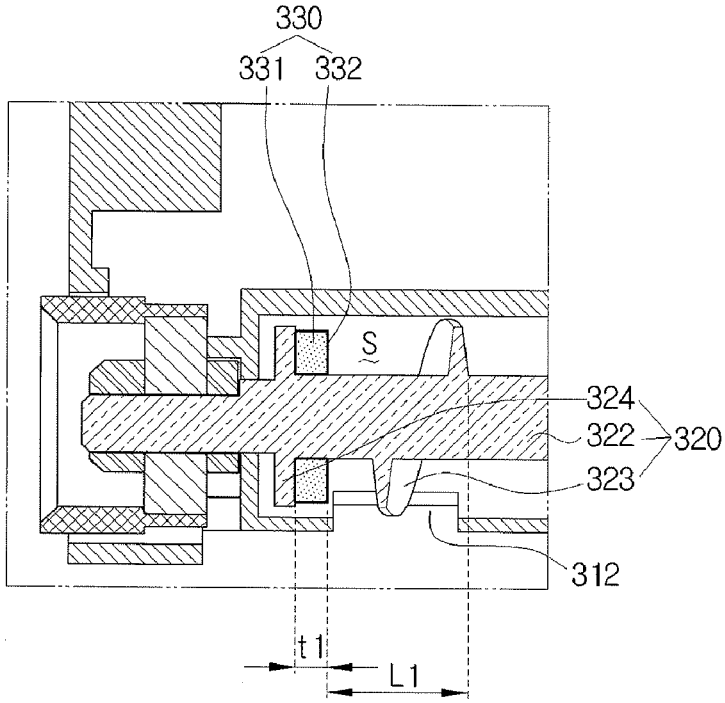
FIGS. 6A and 6B are views illustrating operations to adjust a developer delivery pressure of a developer cartridge according to an example embodiment of the present general inventive concept.

FIG. 6A illustrates a developer conveyed under a normal delivery pressure. Referring to FIGS. 1-6A, the elastic member 331 of the damper 330, placed adjacent to the developer discharging space (S) defined by the vicinity to the developer discharging port 312, maintains original thickness (t1) and original length (L1) along the length of the space (S).

Figure 6B:
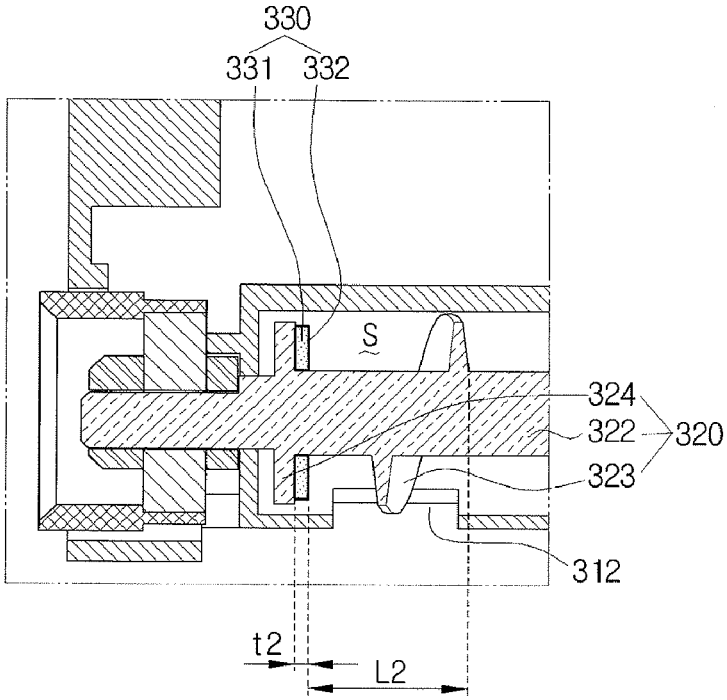

If the amount of a developer being conveyed by the developer conveying unit 320 exceeds the amount of developer being discharged through the developer discharging port 312, the delivery pressure increases in the developer discharging space (S). As a result, as illustrated in FIG. 6B, the elastic member 331 of the damper 330 starts to contract from the point when the delivery pressure exceeds a normal value (or pressure), subsequently diminished in thickness. As a result, a original thickness t1 of the elastic member 331 is decreased to t2, a length of the space (S) is increased to L2, and the pressure is lowered in the space (S).

As the excessive delivery pressure is dissipated in the delivery discharging space (S), the damper 330 and the elastic member 331 recover original states due to a returning force, and the length of the space (S) is also returned to the original length (L1).

Because the elastic member 331 of the damper 330 contracts and expands according to the developer delivery pressure in the developer chamber, mounting of delivery pressure in the developer discharging space (S) and subsequent mounting and hardening of the developer in the space (S) are prevented.

The damper 330 also helps adjust the developer delivery pressure in the developer discharging space (S) by contracting and expanding according to the developer delivery pressure when the developer is lopsided in the developer cartridge 30 due to impact exerted during shipping, or when the developer cartridge 30 has just been replaced.

Because the developer delivery pressure does not increase over a specific pressure which is variable to circumstances due to the operation of the damper 330, the developer is not hardened so as to prevent the locking of stalling of the auger and also prevent the driving unit driving the auger from being overloaded. This effect of preventing auger locking has been proved in a test in which developer is continuously force-fed while blocking the developer discharging port 312 of the developer cartridge 30. While conventional system had auger locking within 14 seconds, the image forming apparatus employing the damper according to the example embodiments of the present invention did not have any of such problems, and also did not have increased driving torque even after the experiment.

With a developer cartridge and an image forming apparatus having the same according to the example embodiments of the present general inventive concept, developer delivery pressure does not mount in a developer chamber and thus auger locking due to hardy toner lump is prevented, by a damper provided inside the developer discharging space which contacts to increase the size of the developer discharge space and release the developer delivery pressure when the delivery pressure mounts above normal degrees.

Furthermore, increased rotation load of an auger can be prevented when the developer is lopsided in the developer cartridge during shipping, or when the developer cartridge has just been replaced, because damper helps release excessive delivery pressure in the developer discharge space.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developer cartridge, comprising:

a cartridge frame comprising a developer chamber to contain a developer therein, and a developer discharging port formed thereon;

a developer conveying unit to convey the developer towards the developer discharging port; and a deformable unit deformable in response to a developer delivery pressure exerted on the developer by the developer conveying unit to change a size of a developer discharge space occupied by the developer and adjacent to the developer discharging port.

2. The developer cartridge of claim 1, wherein the deformable unit comprises a deformable damper installed on the developer conveying unit.

3. The developer cartridge of claim 2, wherein the damper contracts and expands along an axis of the developer conveying unit.

4. The developer cartridge of claim 2, wherein the cartridge frame comprises a shaft hole to accommodate the developer conveying unit installed the cartridge frame, and the developer conveying unit comprises a sealing member to prevent ingress of the developer through the shaft hole of the cartridge frame.

5. The developer cartridge of claim 4, wherein the damper is installed on the sealing member.

6. The developer cartridge of claim 5, wherein the damper comprises an elastic member.

7. The developer cartridge of claim 6, wherein the elastic member comprises one selected from among silicone, urethane, EPDM, NBR, NR, and poron.

8. The developer cartridge of claim 6, wherein the damper further comprises a film member attached to the surface of the elastic member, and the film member is made of a material selected from among PET, PP, urethane, and silicone.

9. The developer cartridge of claim 2, wherein the developer conveying unit is rotatably installed on the cartridge frame to agitate the developer within a developer chamber.

10. The developer cartridge of claim 9, wherein the developer conveying unit comprises an auger having a shaft, and a spiral wing disposed along the outer circumference of the shaft.

11. The developer cartridge of claim 10, wherein the auger further comprises a sealing member to prevent ingress of the developer through a shaft hole of the cartridge frame on which the auger is installed.

12. The developer cartridge of claim 11, wherein the damper comprises an elastic member attached to the sealing member, and a film member attached to the elastic member.

13. An image forming apparatus comprising:

a developing cartridge installed in a main body of the image forming apparatus, to develop an electrostatic latent image on a photosensitive medium with a developer;

a developer cartridge removably mounted to the main body of the image forming apparatus; and a developer conveying duct to connect a developer discharging port of the developer cartridge with the developing cartridge approximately vertically, wherein the developer cartridge comprises, a cartridge frame comprising a developer chamber holding a developer therein, and the developer discharging port, a developer conveying unit to convey the developer towards the developer discharging port, and a deformable unit deformable in response to a developer delivery pressure exerted on the developer by the developer conveying unit to change a size of a developer discharge space occupied by the developer and adjacent to the developer discharging port.

14. The image forming apparatus of claim 13, wherein the deformable unit comprises a deformable damper installed on the developer conveying unit.

15. The image forming apparatus of claim 14, wherein the damper contracts and expands along an axis of the developer conveying unit.

16. The image forming apparatus of claim 14, wherein the cartridge frame comprises a shaft hole to accommodate the developer conveying unit installed the cartridge frame, and the developer conveying unit comprises a sealing member to prevent ingress of the developer through the shaft hole of the cartridge frame.

17. The image forming apparatus of claim 16, wherein the damper is installed on the sealing member.

18. The image forming apparatus of claim 17, wherein the damper comprises an elastic member.

19. The image forming apparatus of claim 18, wherein the elastic member comprises one selected from among silicone, urethane, EPDM, NBR, NR, and poron.

20. The image forming apparatus of claim 18, wherein the damper further comprises a film member attached to the surface of the elastic member, and the film member is made out of a material selected from among PET, PP, urethane, and silicone.

21. The image forming apparatus of claim 14, wherein the developer conveying unit is rotatably installed on the cartridge frame to agitate the developer within a developer chamber.

22. The image forming apparatus of claim 21, wherein the developer conveying unit comprises an auger having a shaft, and a spiral wing disposed along the outer circumference of the shaft.

23. The image forming apparatus of claim 22, wherein the auger further comprises a sealing member to prevent ingress of the developer through a shaft hole of the cartridge frame on which the auger is installed.

24. The image forming apparatus of claim 23, wherein the damper comprises an elastic member attached to the sealing member, and a film member attached to the elastic member.

25. The image forming apparatus of claim 13, wherein the developing cartridge and the developer cartridge each comprise a plurality of cartridges to represent a plurality of colors respectively.

26. A developer conveying unit rotatably installed on a developer cartridge having a developer chamber and a developer discharging port, to agitate the developer inside the developer chamber and move the developer towards the developer discharging port, the developer conveying device comprising:

a shaft;

a plate disposed along the outer circumference of the shaft;

a sealing member to prevent ingress of the developer through a shaft hole of the developer cartridge; and a damper installed on the sealing member deformable in response to a developer delivery pressure exerted on the developer to change a size of a developer discharge space occupied by the developer and adjacent to the developer discharging port.

27. The developer conveying unit of claim 26, wherein the damper contracts in an axis direction when a developer delivery pressure excessively applies in the developer chamber, to expand the size of the developer discharge space and release the excessive developer delivery pressure.

28. The developer conveying unit of claim 26, wherein the damper comprises an elastic member.

29. The developer conveying unit of claim 28, wherein the elastic member comprises one selected from among silicone, urethane, EPDM, NBR, NR, and poron.

30. The developer conveying unit of claim 28, wherein the damper further comprises a film member attached to the surface of the elastic member, and the film member is made out of a material selected from among PET, PP, urethane, and silicone.

31. A developer conveying device useable with a developer cartridge, comprising:

a developer conveying unit to convey a developer to a developer discharge space; and a deformable unit deformable in response to a pressure exerted on the developer existing in the developer discharge space to change a size of the developer discharge space occupied by the developer.

32. The developer conveying device of claim 31, wherein the developer conveying unit comprises a shaft and a plate formed on the shaft to convey the developer toward the developer charge space.

33. The developer conveying device of claim 31, wherein the deformable unit comprises a damper to absorb a pressure of the developer discharge space.

34. A developer cartridge usable with an image forming apparatus, comprising:

a cartridge frame having a developer chamber to contain a developer and a developer discharge space;

a developer conveying unit to convey the developer to the developer discharge space; and a deformable unit deformable in response to a developer delivery pressure exerted on the developer to change a size of the developer discharge space occupied by the developer.

35. The developer cartridge of claim 34, wherein:

the cartridge frame comprises a developer discharge port disposed to communicate with the developer discharge space such that the developer is conveyed toward the developer discharge space and discharged through the developer discharge port; and the deformable unit is deformed to change one of a pressure and density of the developer discharge space to avoid a malfunction of the developer conveying unit.

36. The developer cartridge of claim 34, wherein the deformable unit reduces a pressure of the developer discharge space by changing the size of the developer discharge space.

37. The developer cartridge of claim 34, wherein the deformable unit comprises a first surface to be stationary and a second surface to be movable with respect to the first surface according to the pressure of the developer space.

38. The developer cartridge of claim 34, wherein the second surface forms a portion of the developer discharge space, and the second surface moves to increase the developer discharge space to decrease a pressure of the developer discharge space.

39. The developer cartridge of claim 34, wherein the deformable unit comprises a first surface and a second surface to move between a first position and a second position with respect to the first surface to change the size of the developer discharge space.

40. The developer cartridge of claim 34, wherein the deformable unit is changed between a first shape and a second shape to change a pressure of the developer discharge space.

41. The developer cartridge of claim 34, wherein the deformable unit is a damper formed with the developer conveying unit in a single body to repeatedly move between a first position and a second position according to a pressure of the developer discharge space to adjust the pressure of the developer discharge space.

42. An image forming apparatus, comprising:

a developer cartridge unit having a cartridge frame having a developer chamber to contain a developer and a developer discharge space, a developer conveying unit to convey the developer to the developer discharge space, and a deformable unit deformable in response to a developer delivery pressure exerted on the developer to change a size of the developer discharge space occupied by the developer; and an image forming device to form an image on a printing medium using the developer.

43. A developer conveying device useable with a developer cartridge, comprising:

a developer conveying unit rotatable about an axis extending in an axial direction along the length of the developer cartridge to convey a developer to a developer discharge space; and a deformable unit deformable in the axial direction in response to a pressure exerted on the developer existing in the developer discharge space to change a size of the developer discharge space occupied by the developer in an axial direction.

* * * * *